US007404533B1

(12) United States Patent
Kologe

(10) Patent No.: US 7,404,533 B1
(45) Date of Patent: Jul. 29, 2008

(54) DISPLAY BAR ASSEMBLY FOR MERCHANDISING DISPLAYS

(75) Inventor: Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 11/679,507

(22) Filed: Feb. 27, 2007

(51) Int. Cl.
*A47B 96/06* (2006.01)

(52) U.S. Cl. ..... 248/220.22; 248/251; 248/558; 248/911

(58) Field of Classification Search ..... 248/220.22, 248/558, 911, 243, 251, 254, 261, 262, 266, 248/267; 160/330, 383; 211/16, 78, 105.1, 211/123, 124
See application file for complete search history.

(56) References Cited

U.S. PATENT DOCUMENTS

| | | | | | |
|---|---|---|---|---|---|
| 3,960,275 | A | * | 6/1976 | Haughton et al. | 211/182 |
| 3,983,822 | A | * | 10/1976 | Suttles | 108/108 |
| 4,150,753 | A | | 4/1979 | Stahl et al. | |
| 4,316,546 | A | | 2/1982 | Varon et al. | |
| 4,316,547 | A | | 2/1982 | Varon | |
| 4,455,007 | A | | 6/1984 | Varon et al. | |
| 4,474,299 | A | * | 10/1984 | Andrews | 211/193 |
| 4,874,148 | A | * | 10/1989 | Guinter | 248/220.22 |
| D368,218 | S | * | 3/1996 | Klein, III | D8/354 |
| 5,582,376 | A | * | 12/1996 | Thompson | 248/214 |
| 6,029,833 | A | * | 2/2000 | Yeh | 211/189 |
| 6,062,399 | A | | 5/2000 | Henry et al. | |
| 6,293,507 | B1 | * | 9/2001 | Gorniak | 248/243 |
| 2006/0021722 | A1 | * | 2/2006 | Nien | 160/330 |

* cited by examiner

*Primary Examiner*—Korie H. Chan
(74) *Attorney, Agent, or Firm*—Schweitzer Cornman Gross & Bondell LLP

(57) ABSTRACT

A display bar assembly for mounting on spaced apart slotted uprights on a merchandising gondola or the like. A tubular display bar of polygonal cross section is fitted with a pair of mounting brackets, which are slidable along the bar to enable spacing of the mounting brackets to agree with the spacing between the slotted uprights, which can be somewhat variable. The mounting brackets are formed with openings which closely and non-rotatably receive the display bar and are provided with hook-like tabs which engage slots in the uprights. Flanged end plugs are received tightly in each end of the display bar to prevent removal of the slidable brackets, such that the display bar and bracket form a permanent assembly. The mounting brackets may have multiple hook-like tabs for installation on uprights of different thicknesses.

3 Claims, 5 Drawing Sheets

DISPLAY BAR ASSEMBLY FOR MERCHANDISING DISPLAYS

BACKGROUND OF THE INVENTION

Merchandise displays frequently are arranged by mounting shelves and other display elements on a gondola or other display wall. Commonly, such display walls are provided with spaced apart, slotted uprights in the form of U-shaped metal channels provided substantially along their full length with uniformly spaced apart slots. The slots are adapted to receive shelf brackets, for example, and various other devices and apparatus utilized in connection with the display of merchandise.

One common display apparatus consists of a horizontal display bar, typically of square or rectangular cross section, which is held at its opposite ends by brackets. The brackets are arranged for adjustable movement along the length of the display bar, to accommodate for different spacings between uprights, and serve to mount the display bar on the uprights. Typically, the mounting brackets are provided with upwardly opening recesses to receive the display bar. In some cases, openings, closed on all sides, receive the display bar.

A serious disadvantage of these prior art devices is that the mounting brackets are separable from the display bar. Accordingly, when the display facilities are removed from the uprights, and reused elsewhere or stored between uses, the mounting brackets easily can become separated and lost or misplaced relative to the display bar for which they were intended. A display bar with a single mounting bracket is useless and much valuable employee time can be wasted trying to find all of the parts of a set so that they may be properly reused. The net result, frequently is considerable inefficiency and unnecessary expense and in the managing of store displays.

SUMMARY OF INVENTION

A display bar assembly according to the invention is comprised of a display bar of polygonal configuration, typically square, and preferably hollow. Mounting brackets are provided for each end of the display bar, and these are formed with openings, closed on all sides, and of a configuration corresponding to that of the display bar. When applied over the display bar, the mounting brackets are nonrotatable with respect to the bar.

Pursuant to one aspect of the invention, retaining elements, preferably in the form of flanged plugs, are applied to each end of the display bar, after the mounting brackets are assembled thereon. The retaining elements advantageously are in the form of flanged plugs, which can be inserted in and tightly retained by the opposite ends of the display bar. The plugs form and end flange at the end extremity of the display bar, to prevent the removal of the mounting brackets. In this respect, the device of the invention is a complete assembly of the display bar and mounting brackets, with the brackets being effectively nonremovable and always with the display bar for use when and where the store manager desires.

In a preferred embodiment of the invention, the mounting brackets each provided with a pair of angularly oriented mounting hooks arranged to be received in slots in the spaced uprights, as a means for attaching the display bar assembly to the uprights. The slot-engaging hooks are of generally L-shaped configuration defining, with an edge of the bracket, a slot for receiving wall material of the upright, when the hook is engaged in a slot. To advantage, the two hooks are positioned on adjacent side edges of the brackets, oriented at 90 degrees to each other. The recess formed by one of the hooks is of greater width than that of the adjacent, angularly disposed hook. The arrangement is such that, by rotating the bar and bracket assembly 90 degrees, a different pair of slot-engaging hooks can be positioned to be inserted in the uprights. This arrangement accommodates the fact that some uprights are formed with heavier, thicker metal walls than others, and the best fit can be achieved easily with the assembly of the invention by rotating the bar to select the proper width of hook recess.

Desirably, the slot-engaging hooks provided on the mounting brackets are offset slightly to the outside of the principal plane of the brackets. Thus, in cases where two display bars are mounted more or less end to end in a display arrangement, adequate clearance is provided for the presence of the flanged end plugs.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
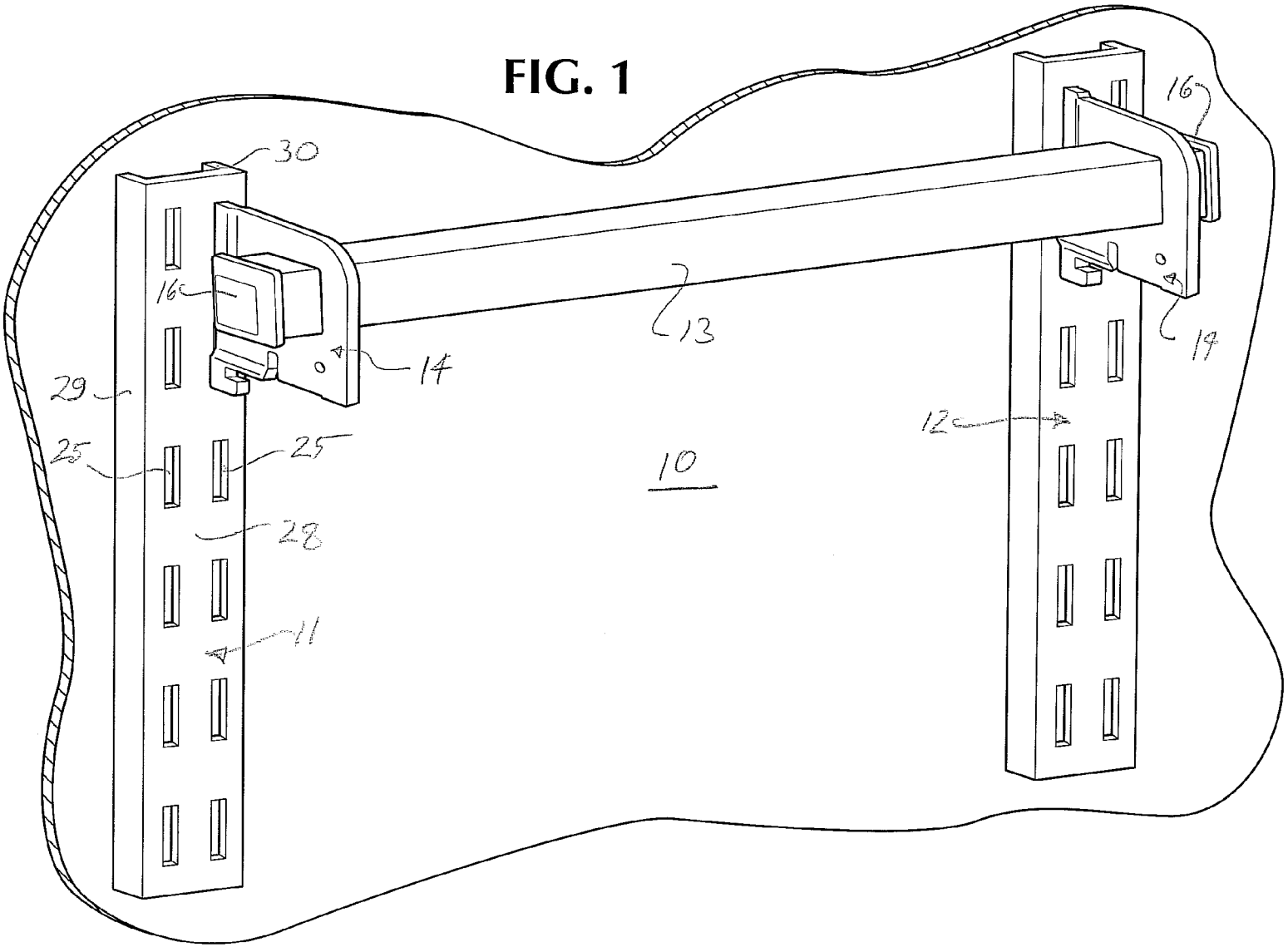
FIG. 1 is a perspective view of a typical merchandise display structure on which a display bar assembly according to the invention has been installed.
Figure 2:
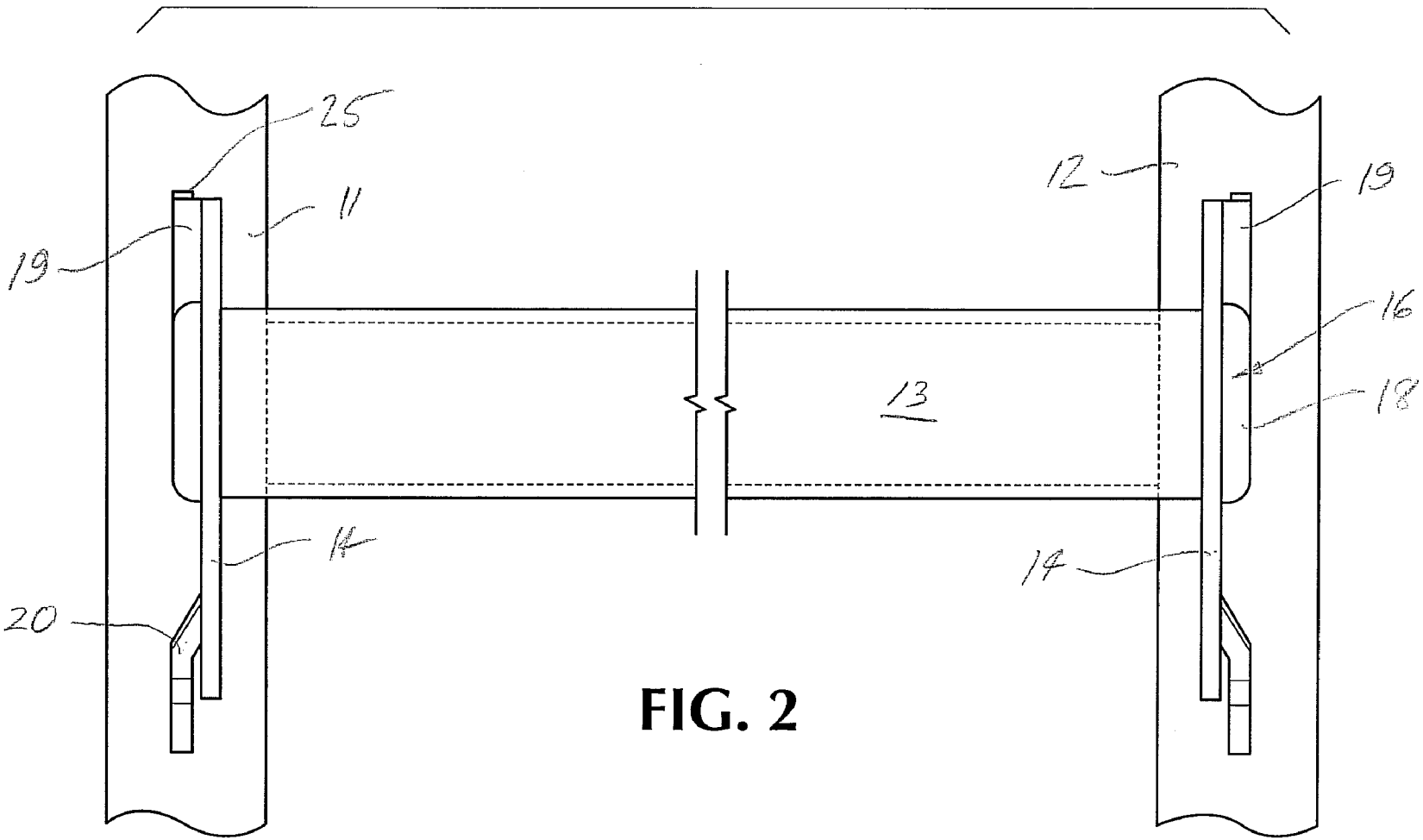
FIG. 2 is a front elevational view of an installation similar to that of FIG. 1.

Referring now to the drawings, the reference numeral 10 designates generally a display wall, which can be a gondola, for example, or simply a vertical wall structure. Mounted on the wall 10 are spaced apart slotted uprights 11, 12, which are suitably secured to the wall 10 and extend vertically more or less along its entire vertical extent. Typical merchandise display arrangements tend to use somewhat standardized spacings for the uprights 11, 12, for example approximately thirty inches, thirty-six inches and forty-eight inches. The uprights can be used for mounting a wide variety of display devices, such as shelf-supporting brackets, bins, etc. and including display bars such as shown at 13 in FIG. 1. Typically, the display bars themselves are used to mount hooks or other devices on which merchandise can be suspended and displayed.

At each end of the display bar 13 is a mounting bracket 14, to be described further, by which the display bar 13 is mounted on and secured to the uprights 12. Typically, the spacing between the uprights 11, 12, though more or less standardized, frequently is inaccurate. Accordingly, it is customary for mounting brackets to be adjustably associated with the display bar mounted thereby. Commonly, the brackets are provided with upwardly opening recesses for receiving the display bar. After mounting of the brackets on uprights, the display bar is lowered into the upwardly opening recesses, which nonrotatably retain the display bar. In some cases, the brackets are formed with openings which are closed on all sides, and the brackets are slidably assembled onto the ends of the display bar before the brackets are engaged with the uprights. In either case, the brackets are separable from the display bar and often become misplaced, resulting in considerable inefficiency and expense to the storekeeper. In the system of the invention, the mounting brackets 14, are formed with openings 15, closed on all sides, and configured to closely but slidably receive the display bar 13. In the illustrated arrangement, the display bar 13 has a square cross section, uniform along its full length, and the openings 15 are of a corresponding shape, with a small clearance provided to accommodate slidable adjustments of the bracket. Unlike the prior art, however, the display assembly of the invention includes means for permanently retaining the mounting brackets on the display bar 13.

Figure 3:
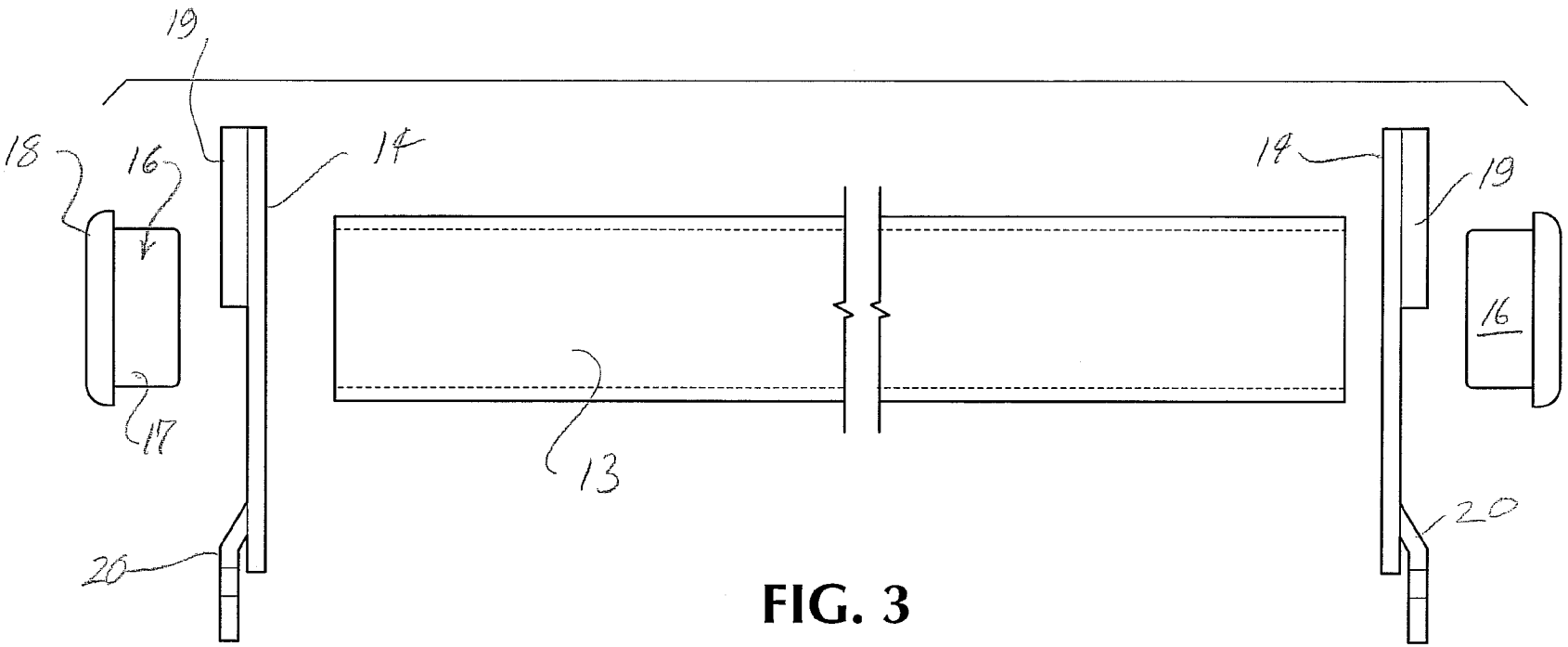
FIG. 3 is an exploded view of the display bar assembly of the invention.

In the assembly of the invention, after initial assembly of the brackets 14 onto the display bar, flanged end plugs 16 are applied to the opposite ends of the display bar. As shown in FIG. 3, the flanged plugs are formed with a body portion 17, of a size and shape to fit inside the hollow display bar, with a tight friction fit such that, once applied to the end of the display bar, the plugs 16 will be removable only with great difficulty. The plugs are each provided with an outwardly projecting flange portion 18. The dimensions of the projecting flange portions 18 are at least slightly greater than the dimensions of the bracket openings 15, so that after application of the plug 16 to the display bar, the mounting brackets 14 are blocked by the end plugs 16 and can no longer be removed. Thus, at all times, the display bar and its mounting brackets will comprise an assembly unit. When the time comes to retrieve a display assembly from storage or otherwise ready it for mounting on a pair of uprights 11, 12, there can be no problems with lost or missing brackets, as is consistently experienced with devices of previous design. The flanged end plugs 16 can be formed of a suitable tough plastic material such that they can easily be tapped into the ends of the display bar, but not easily removed therefrom.

Figure 5:
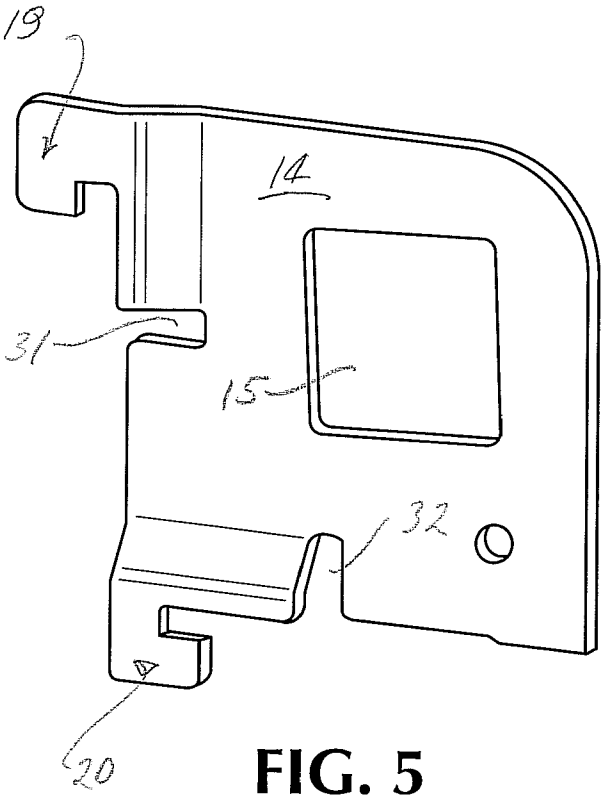
FIG. 5 is a perspective view of the mounting bracket according to the invention.
Figure 4:
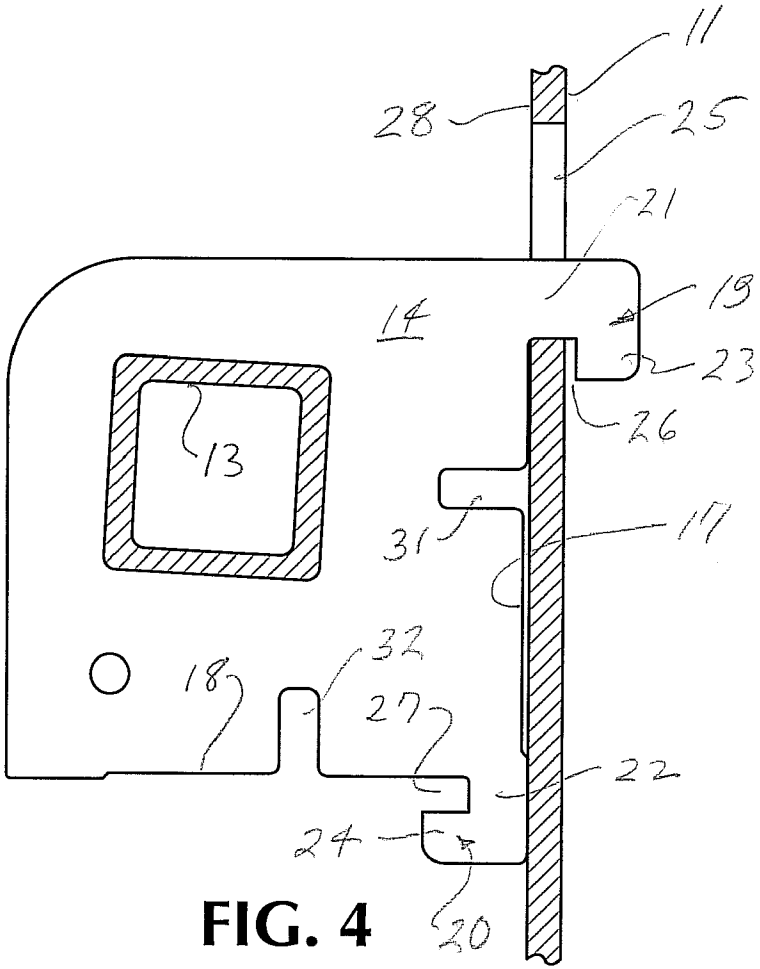
FIG. 4 is a cross sectional view as taken generally on line 4-4 of FIG. 2.

Referring now to FIGS. 4 and 5, mounting brackets incorporated in the preferred embodiment of the invention comprise sheet metal stampings preferably somewhat squarish in outline, with side edges 17, 18 disposed at right angles. On the side edges 17, 18, there are formed mounting hooks 19, 20 respectively, which are generally of L-shaped configuration comprising lateral extensions 21, 22 and hook portions 23, 24. The two mounting hooks 19, 20 are oriented at right angles to each other arranged such that 90 degrees rotation of the display bar 13 enables a selected pair of the hooks 19, 20 to be received in slots 25 in the uprights.

Recesses 26, 27 are formed between the respective side edges 17, 18 of the mounting brackets and the hook portions 23, 24. To advantage, the widths of the respective recesses 26, 27 differ, so as to more suitably fit with the uprights 11. In this respect, the uprights typically are of a U-shaped cross section, with front walls 28 and side walls 29, 30, typically formed of rolled sheet metal. Some uprights may be of a heavier gauge construction than others, for supporting heavier loads. Thus, the recesses 26, 27 of the mounting brackets are arranged in different widths, to fit more appropriately on heavier gauge and light gauge uprights.

Preferably, the mounting hooks 19, 20 of the brackets 14 are offset a short distance (for example an eighth inch) from the outside face of the bracket. In this respect, the brackets will be provided in pairs for installation at the left and right ends respectively of the display bar, with the hook portions being offset to the outside, substantially as shown in FIG. 3. To accommodate the offsetting of these hook portions, the brackets are formed with cutouts 31, 32 extending into the bracket body from the respective side edges 17, 18, so that the portion of the bracket adjacent to the hook can be appropriately displaced out of the principal plane of the bracket.

Figure 6:
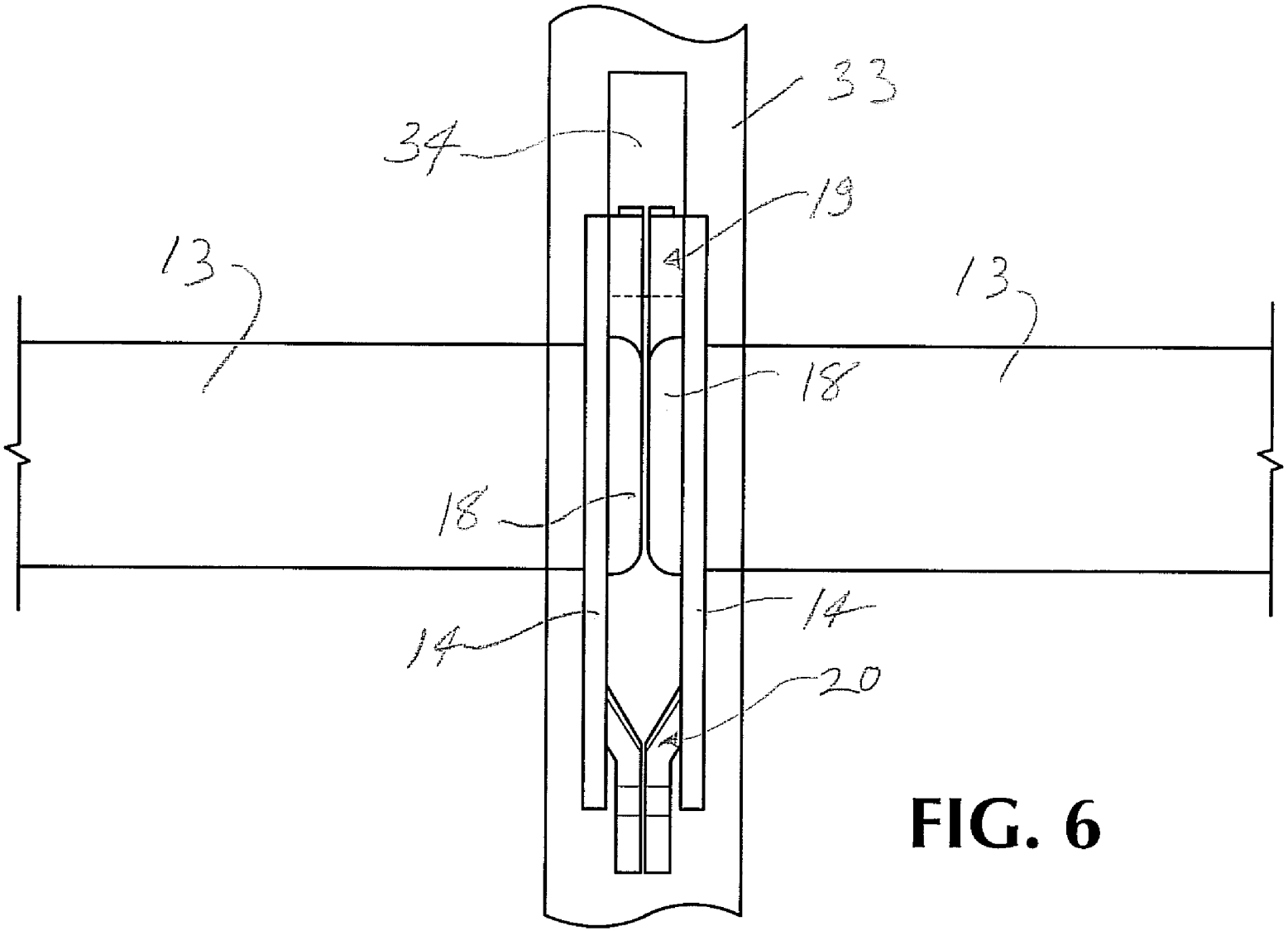
FIG. 6 is a fragmentary front elevational view illustrating two display bars arranged in an end-to-end configuration in a typical merchandise display.

The displacement of the hooks 19, 20 is advantageous for installations, such as shown in FIG. 6, in which an upright 33 may be provided with vertically spaced slots 34 of double width, in place of the alternative form in which the slots 25 are provided in adjacent pairs, as shown in FIG. 1. In an arrangement as shown in FIG. 6, where it may be desired to have display bars 13 aligned axially, end-to-end, the offsetting of the mounting hooks 19, 20 allows space between the main body of the brackets 14 to receive the flange portions 18 of the end plugs.

An important practical advantage of the invention is that the display bar and its mounting brackets constitute a unitary assembly, with the mounting brackets being permanently joined with the display bar. Important savings in both cost and man-hours of store labor can be realized by avoiding the annoying problem of lost and misplaced components, which inevitably occurs when the mounting brackets are not a fixed part of the display assembly.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A display bar assembly for mounting on spaced apart slotted uprights on a merchandising wall, which comprises (a) a tubular display bar of rectangular cross section and of predetermined length, (b) first and second mounting brackets for securing said display bar to said spaced apart uprights, (c) said mounting brackets each having an opening for close-fitting but slideable, non-rotating reception of said display bar, (d) said opening being sufficiently closed on all sides that said display bar can be removed therefrom only by movement in the direction of a longitudinal axis of the display bar, (e) each of said mounting brackets being formed with a pair of adjacent side edges disposed at right angles to each other and each such side edge being formed with a slot engaging hook receivable in slot openings in said uprights, with each hook being disposed at right angles with respect to the other hook on the same bracket, (f) each of the slot engaging hooks of a mounting bracket defining, together with the side edge of the bracket on which it is formed, a recess of different width for reception in slotted uprights of different wall thicknesses (g) said mounting brackets being slidably adjustable lengthwise along said display bar to match the spacing between said slotted uprights, and (h) retainer elements received on said display bar at each end thereof, (i) said retainer elements comprising flanged plugs received internally of said display bar at each end thereof, and (j) outwardly projecting flange portions of said plugs extending beyond outer surface portions of said display bar to prevent removal of said mounting brackets therefrom.

2. A display bar assembly according to claim 1, wherein (a) said mounting brackets are slideable to end extremities of the display bar, (b) said brackets being of generally flat sheet metal material having inner and outer faces, (c) said slot engaging hooks being offset laterally a distance outward of the outer faces of said brackets whereby, upon installation of said slot engaging hooks in a slot or slots in an upright, the outer faces of said brackets will be offset from said slots in an inward direction relative to said display bar a distance sufficient to accommodate the presence of a pair of opposed retainer elements of a pair of display bar assemblies positioned end to end.

3. A display bar assembly according to claim 2, wherein (a) said mounting brackets comprise sheet metal stampings of generally flat form, (b) each of said adjacent side edges being shaped in an end portion thereof to form one of said slot engaging hooks, (c) each such end portion being defined in part by a slot in said sheet metal stamping extending inward from the side edge thereof to form a displaceable portion including the slot engaging hook formed therein, and (d) said displaceable portion being displaced into a plane offset from the principal plane of said stamping.

* * * * *